US005906075A

United States Patent [19]

Sowers

[11] Patent Number: 5,906,075

[45] Date of Patent: May 25, 1999

[54] MODULAR BUILDING STRUCTURE

[76] Inventor: John Mark Sowers, 2040 Chartstone Dr., Midlothian, Va. 23113

[21] Appl. No.: 08/796,149

[22] Filed: Feb. 6, 1997

[51] Int. Cl.[6] ..... E04H 1/00

[52] U.S. Cl. ..... 52/79.8; 52/79.1; 52/79.9; 52/79.13; 52/126.1; 52/126.7; 52/127.7; 52/127.8; 52/169.12; 52/293.3; 52/295

[58] Field of Search ..... 52/79.1, 79.4, 52/79.7, 79.8, 79.9, 79.11, 79.13, 79.14, 79.3, 126.1, 126.3, 126.4, 126.7, 125.3, 125.4, 125.5, 127.5, 127.7, 127.8, 127.12, 169.12, 293.1, 293.2, 293.3, 295, 223.1, DIG. 11, 23, 143, 79.6, 169.9

[56] References Cited

U.S. PATENT DOCUMENTS

| | | | |
|---|---|---|---|
| 314,367 | 3/1885 | Cook | 52/223.1 X |
| 650,900 | 6/1900 | Knopfe | 52/126.7 |
| 1,210,688 | 1/1917 | Peirce et al. | 52/23 |
| 1,417,736 | 5/1922 | Heygate | 52/69 |
| 1,996,358 | 4/1935 | Werner | 52/126.7 |
| 2,396,829 | 3/1946 | Carpenter | 52/293.1 X |
| 2,691,291 | 10/1954 | Henderson | 52/79.9 |
| 3,200,546 | 8/1965 | Losak | 52/94 |
| 3,708,931 | 1/1973 | Button | 52/169.12 X |
| 3,724,151 | 4/1973 | Kaywood et al. | 52/295 |
| 4,023,317 | 5/1977 | Bettger et al. | 52/81.4 |
| 4,255,912 | 3/1981 | Kovacs | 52/79.8 |
| 4,275,538 | 6/1981 | Bounds | 52/126.1 X |
| 5,152,108 | 10/1992 | Madl, Jr. | 52/DIG. 11 X |
| 5,279,085 | 1/1994 | DiPaolo et al. | 52/169.2 |
| 5,623,792 | 4/1997 | Crumpacker | 52/126.7 |
| 5,661,931 | 9/1997 | Johansson | 52/126.1 X |

FOREIGN PATENT DOCUMENTS

| | | | |
|---|---|---|---|
| 61199 | 4/1975 | Australia | 52/126.7 |
| 146088 | 2/1936 | Austria | 52/126.1 |
| 768344 | 10/1967 | Canada | 52/79.1 |
| 2-104829 | 4/1990 | Japan | 52/126.1 |
| 1086986 | 10/1967 | United Kingdom | 52/126.7 |
| WO 94/05879 | 3/1994 | WIPO | 52/79.1 |

*Primary Examiner*—Carl D. Friedman
*Assistant Examiner*—Laura A. Callo

[57] ABSTRACT

A prefabricated, movable and reusable, semipermanent modular building structure is provided for attachment to a common hallway of an existing permanent building for expanding the size thereof. It is based on a plurality of foundation units arranged along the ground to define a contiguous perimeter of the structure and, optionally, interior support within the perimeter. Each foundation unit on the perimeter can have a decorative finish on one vertical face thereof. Every foundation unit includes a mechanism for leveling same relative to adjacent foundation units, and a fixture for the coupling of a tie-down thereto. At least one building unit rests atop the foundation units. A portion of each building unit located over any of the foundation units can be moved to provide access to the foundation unit's leveling mechanism and tie-down fixture. A tie-down device is used to couple the building unit to the tie-down fixture of a foundation unit.

19 Claims, 7 Drawing Sheets

MODULAR BUILDING STRUCTURE

Field of the Invention

The invention relates generally to building structures, and more particularly to a modular building structure that can be used to expand a permanent structure, and be easily disassembled for re-use when no longer needed.

BACKGROUND OF THE INVENTION

A simple method of facility expansion (e.g., as in the case of schools) includes the use of free-standing trailers or mobile office units that have been pre-fabricated and delivered to a site. While these units include their own climate control and lighting systems, and lend themselves to quick set-up, they also present a variety of problems. For example, the occupants have to walk outside when moving between the existing facility and the mobile unit(s). In addition, the nature of mobile units prevent them from being large enough to serve as a library, cafeteria, or other large facility space that must be shared by all occupants. Accordingly, while the use of mobile units provides for additional occupants, the existing shared facility spaces might not be designed to accommodate the additional occupants. Further, the mobile units are not generally compatible with the existing facility architecture and are often considered to be an eyesore. Combining this perception with the fact that the occupants are isolated from the main existing facility can lead to poor morale for the occupants relegated to the mobile units. Still further, the mobile nature of these units makes them more susceptible to storm and wind damage thereby possibly placing the occupants thereof in peril in the event of unexpected bad weather.

SUMMARY OF THE INVENTION

Accordingly, it is an object of the present invention to provide a structure that can be assembled to adjoin an existing permanent structure and work in combination therewith. The existing structure may be of vintage construction or newly built.

Another object of the present invention is to provide a modular structure that can be easily assembled to adjoin an existing permanent structure and be compatible therewith both functionally and architecturally.

Still another object of the present invention is to provide a modular structure that can be easily disassembled when there is no longer a need therefor at a first location and either put in storage or used at another location.

Other objects and advantages of the present invention will become more obvious hereinafter in the specification and drawings.

In accordance with the present invention, a modular building structure is based on a plurality of foundation units arranged contiguously along the ground to define a perimeter of the structure. Each foundation unit has a decorative finish on one vertical face thereof, a mechanism for leveling same relative to adjacent foundation units, and a fixture for the coupling of a tie-down thereto. When used in the expansion of an existing structure, the decorative finish can be selected to be architecturally compatible with the exiting structure. At least one building unit rests atop the foundation units. A portion of each wall of a building unit located over any of the foundation units can be moved to provide access to the foundation unit's leveling mechanism and tie-down fixture. A tie-down device is used to couple the building unit to the tie-down fixture of a foundation unit. Additional foundation units can be used to span the perimeter of the structure in order to provide additional support for the building unit(s).

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
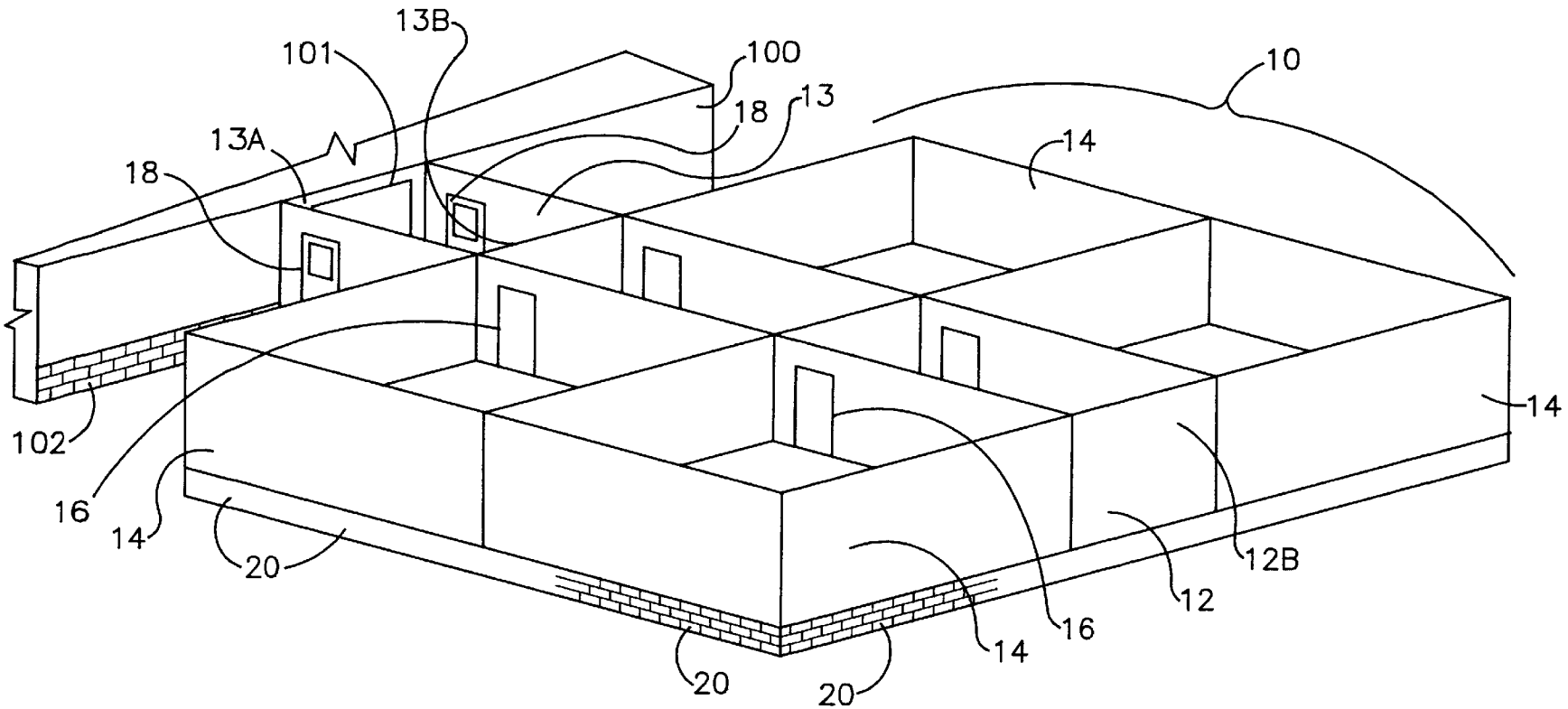
FIG. 1 is a perspective view of a modular building structure of the present invention (with its roof sections omitted for clarity) coupled to an existing structure via the modular building structure's hallway structure.

Referring now to the drawings, and more particularly to FIG. 1, one embodiment of a modular, semipermanent reusable building structure is shown and referenced generally by numeral 10. (The roof is omitted in FIG. 1 for sake of clarity.) Modular building structure 10 is shown coupled to an existing permanent and complete building structure 100 which is shown in part. Existing structure 100 represents any permanent structure, e.g., school or office building, having a new or existing hallway opening 101 providing access to modular building structure 10.

Modular building structure 10 is based on a plurality of self-contained exterior foundation units 20 arranged on the ground in a contiguous pattern to define the perimeter of structure 10. Depending on the size and shape of modular building structure 10, additional or interior foundation units may be required (not shown in FIG. 1) within the perimeter defined by exterior foundation units 20 as will be explained further below. Each of exterior foundation units is preferably finished on its exterior face with a decorative finish (e.g., brick as shown) that is, preferably, architecturally compatible with foundation 102 of existing structure 100. As used herein, "architecturally compatible" means that the decorative finish on foundation units 20 either matches foundation 102, closely matches foundation 102, or complements foundation 102 in a manner that is aesthetically acceptable. Likewise, the semipermanent reusable modular building should be architecturally compatible in its entirety with the existing structure to which it is attached.

Resting atop and coupled to exterior foundation units 20 are a plurality of facility units which are prefabricated, semipermanent and movable (the details of which will be explained below) to define, for example, a central hallway 12 leading from hall opening 101 and a plurality of rooms 14. Each room 14 has a doorway (with or without a door attached) 16 accessing hallway 12. To provide exterior access to hall opening 101 and the inboard end 12A of hallway 12, modular building structure 10 also includes a hall or structural unit 13 that spans opposing exterior foundation units 20. Hall structure 13 forms an extension of central hallway 12. Doors 18 in hall structure 13 provide access thereto from the outside of modular building structure 10.

Figure 2:
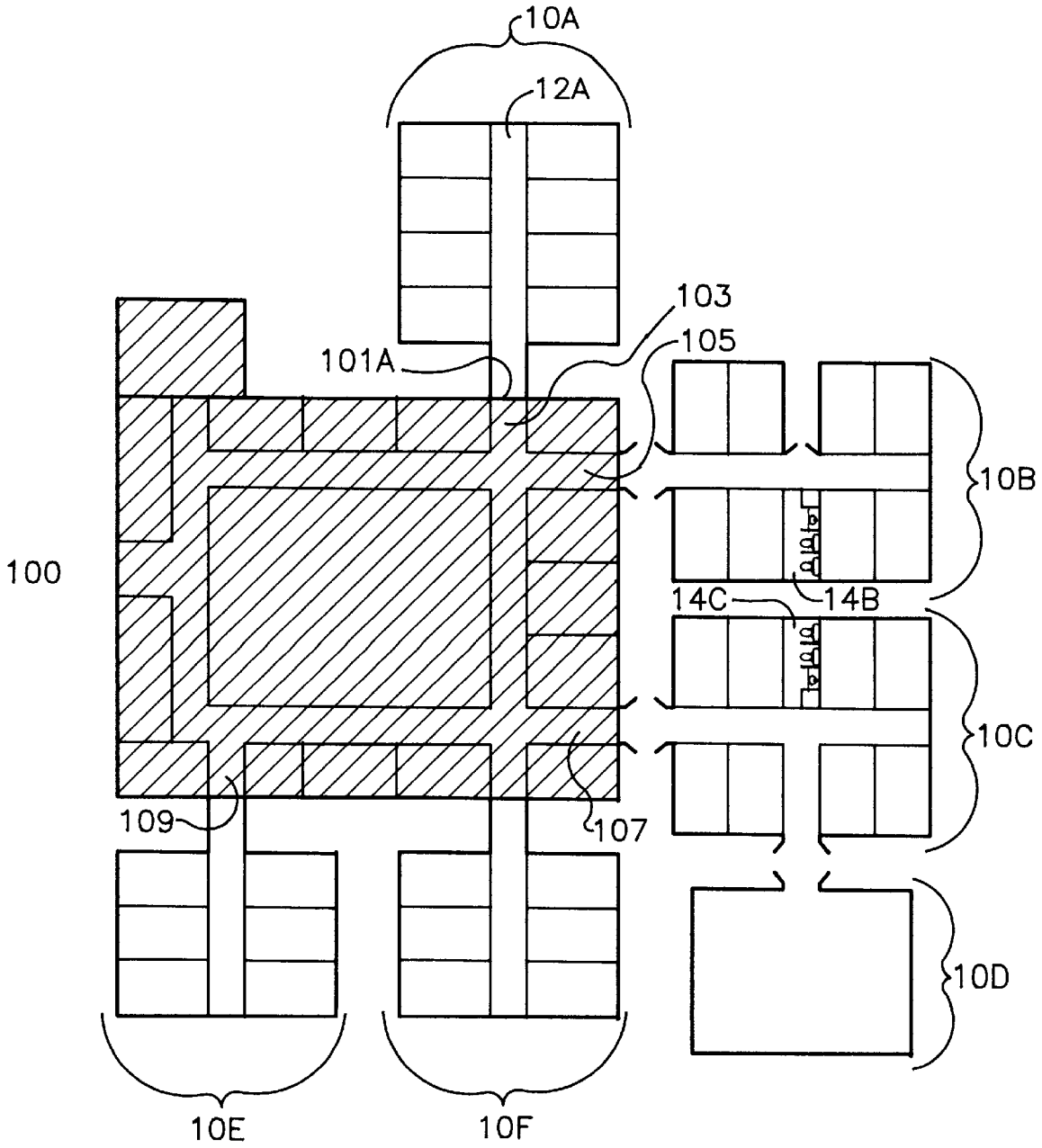
FIG. 2 is a floor plan view depicting one possible arrangement of multiple modular building structures of the present invention coupled to an existing permanent structure and existing one of the modular building structures.

The use of modular structures according to the present invention as part of an overall expansion plan is depicted in FIG. 2 where the floor plan of existing structure 100 is hatched. A first modular building structure 10A is coupled to a doorway 101A of existing structure 100 with hallway 12A serving as a continuation of hallway 103 of existing structure 100. In this way, the facilities provided by modular building structure 10A are essentially integrated with the facilities of existing structure 100. In a similar fashion, modular building structures 10B and 10C are extensions of facilities provided on hallways 105 and 107, respectively, of existing structure 100. Note that the modular building structures can include restroom facilities such as restrooms 14B and 14C. The present invention can also be used to expand from modular building structures themselves. This is shown in FIG. 2 where modular building structure 10D is coupled to modular building structure 10C. In this instance, structure 10D is a large facility, e.g., gym, cafeteria, meeting room, etc. The modular building structures of the present invention could also be coupled to a newly created entrance/egress of existing structure 100. For example, an existing room 109 could be modified to form a passageway used to couple modular building structure 10E to existing structure 100. Future expansion is represented by modular building structure 10F, the floor plan of which is represented in dashed-line form. As shown in FIG. 2, each modular building 10A, 10B, 10C, 10E and 10F is made up of 8, 10, 10, 6 and 6 facility units, respectively, and each includes one hall structure.

Figure 3:
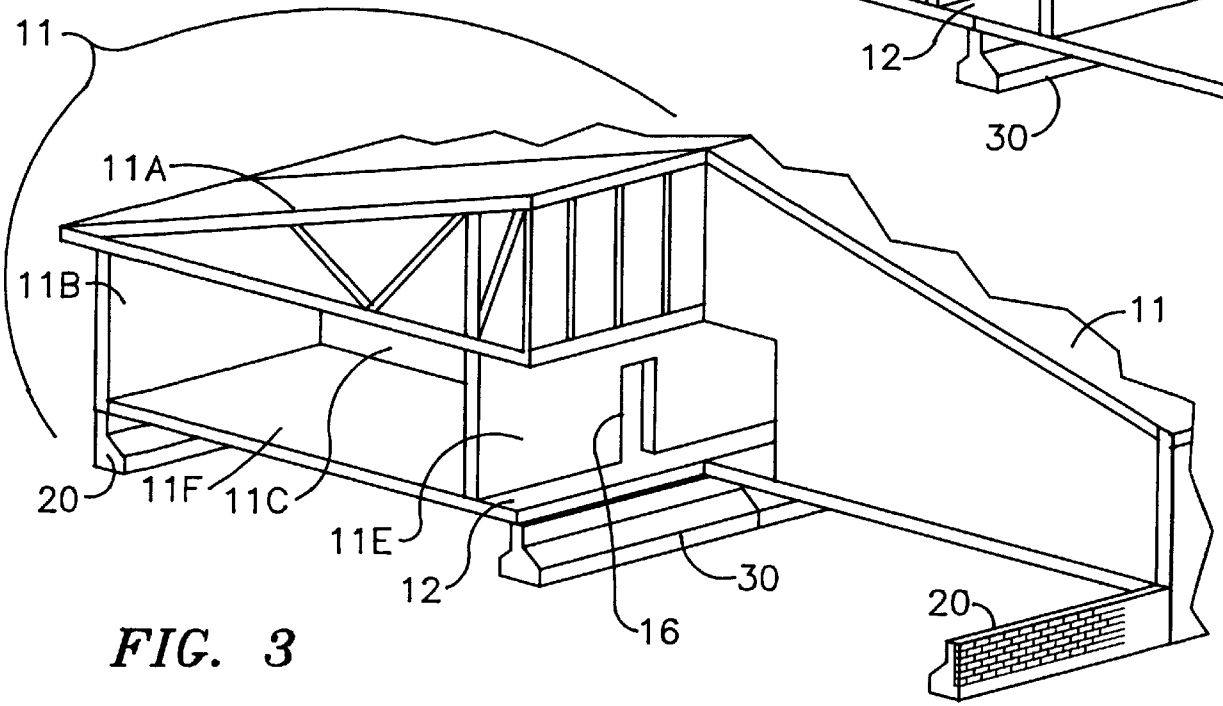
FIG. 3 is a perspective view of a modular building structure of the present invention during the assembly thereof.

One method of assembling a modular building structure of the present invention will now be explained by the progression shown in FIGS. 3, 4 and 5. In FIG. 3, a portion of the perimeter of the modular building structure is defined by exterior foundation units 20 while support between exterior foundation units 20 is provided by a plurality of interior foundation units 30. In the embodiment shown, each prefabricated facility unit 11 includes a roof 11A (e.g., a truss roof is shown), walls 11B, 11C, 11E and a floor 11F. Each facility unit 11 defines a portion (e.g., half) of a room such as room 14 in FIG. 1, and a portion (e.g., half) of central hallway 12. Each facility unit 11 is a prefabricated module that forms an over-the-road movable, semipermanent structure that when joined together with other facility units 11 forms a reusable modular building which requires at least two of such facility units. Generally, two facility units join together to produce a typical classroom that is 24 feet by 36 feet with a shared hall that is completed by another across-the-hall similar classroom. The completed shared hall is typically 12 feet wide with 6 feet thereof being contributed by each opposing facility unit. Thus, each facility unit is typically 12 feet by 42 feet, a size which lends itself to easy transportation by existing roads.

Each facility unit 11 is supported at its exterior by one (or more) of exterior foundation units 20 and at its interior by one (or more) interior foundation units 30. In the embodiment shown, floor 11F (e.g., a joist or truss floor) spans from exterior foundation unit(s) 20 to interior foundation unit(s) 30. In FIG. 4, the next facility unit 11 is placed atop foundation units 20 and 30 to define a portion of a room across hallway 12 from the portion of the room shown in FIG. 3. In FIG. 5, the outboard end of the completed modular building structure is shown after it has been enclosed by end wall 60 and includes an exterior door 19 providing access to hallway 12 shown in FIGS. 3 and 4. Also, a window 62 has been added.

Figure 6:
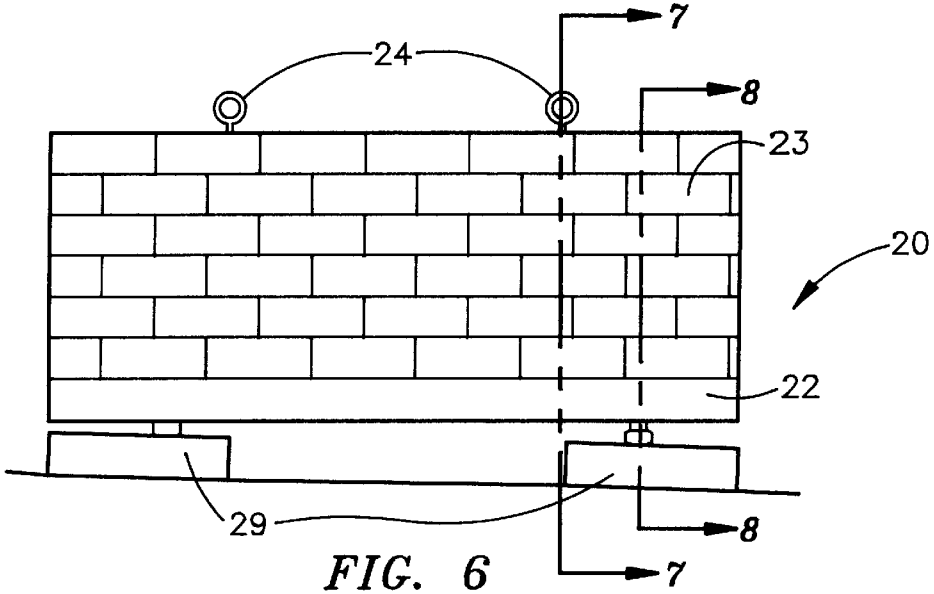
FIG. 6 is an elevation view of an exterior foundation unit that has been leveled in accordance with the present invention.
Figure 8:
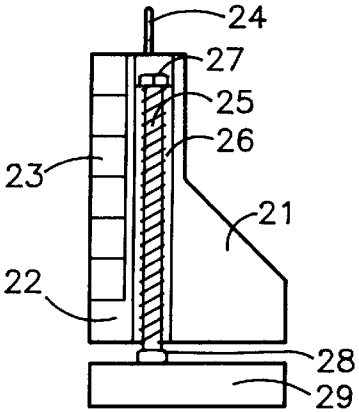
FIG. 8 is a cross-sectional view of FIG. 6 taken along line 8—8 thereof depicting one of the exterior foundation unit's leveling mechanisms.
Figure 7:
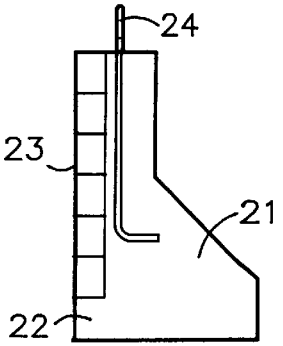
FIG. 7 is a cross-sectional view of FIG. 6 taken along line 7—7 thereof depicting the eye bolt embedded in the exterior foundation unit used to lift and place the exterior foundation unit and serve as a fixture for the coupling of a tie-down.

One embodiment of exterior foundation units 20 will now be explained with simultaneous reference to FIGS. 6, 7 and 8, where FIG. 6 is an elevation view and FIGS. 7 and 8 are cross-sectional views taken along lines 7—7 and 8—8, respectively, of FIG. 6. In the illustrated embodiment, foundation unit 20 has a rigid base 21 made from a heavy material, e.g., steel reinforced concrete. Base 21 is formed with a lower shoulder 22 supporting a decorative foundation finish such as a brick facade 23. Embedded in base 21 are one or more (two are shown) eye bolts 24 that are used to lift foundation unit 20 and are used as tie-down points for the securing of each facility unit as will be explained further below.

Figure 11:
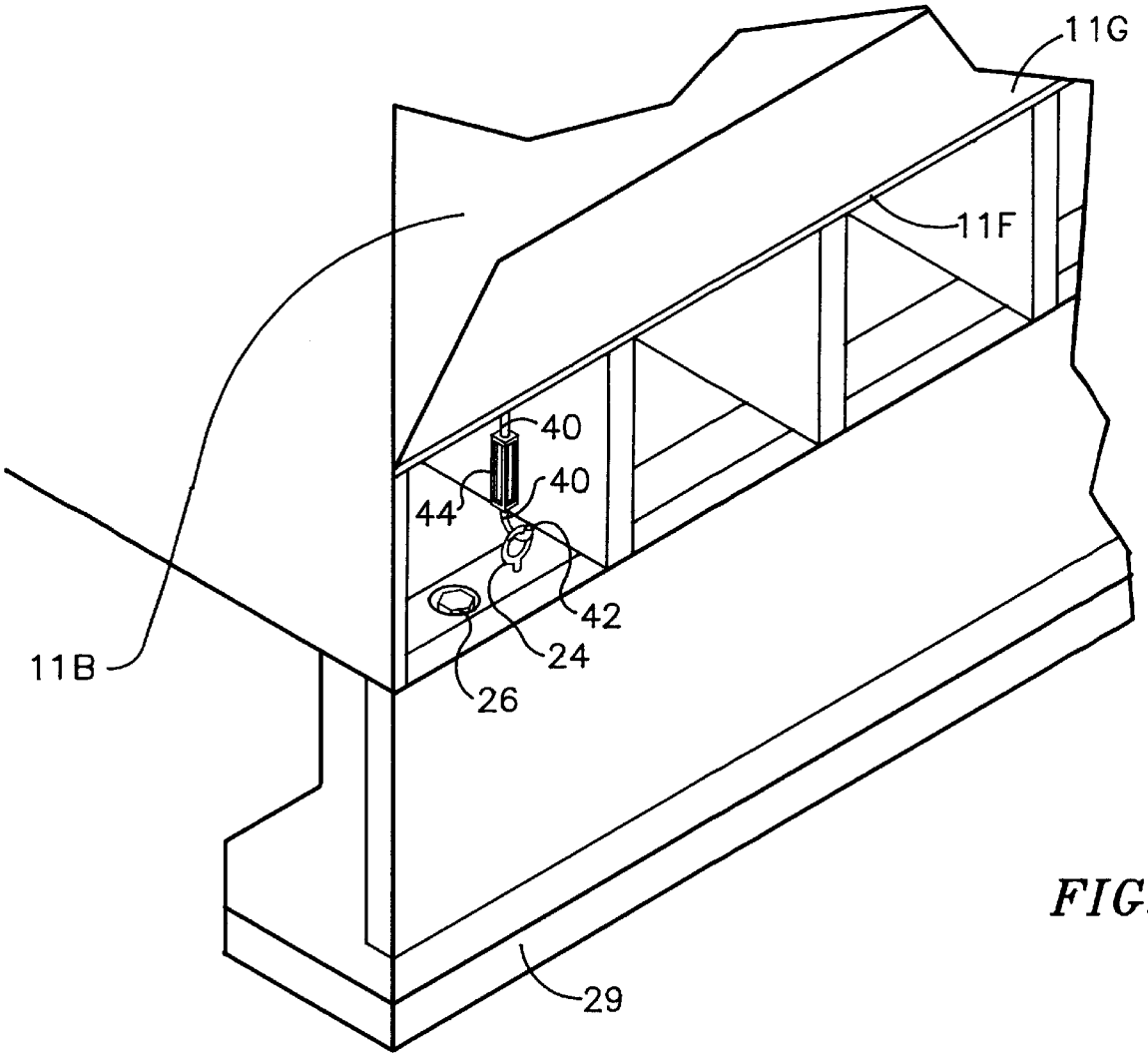
FIG. 11 is a perspective view depicting an open access panel of a facility unit's wall and one embodiment of a tie-down device used to couple the facility unit to an exterior foundation unit.

Foundation unit 20 functions as a beam and is of sufficient strength for that purpose. Foundation unit 20 also includes a mechanism for leveling same on uneven ground. In the illustrated embodiment, the leveling mechanism is a plurality (e.g., two) screws 25 rotatable within a threaded sleeve 26 embedded in base 21. Screw 25 is accessible from the top of base 21 and can be rotated to extend from the bottom of base 21. Each of screws 25 is rotated to cooperate with the ground to level the top of base 21 relative to adjacent foundation units. Each screw 25 can be provided with a recessed (socket) head 27 to facilitate rotation and a base 28 to provide stability. Depending on the ground surface, it may be desirable to place rigid (e.g., concrete) pad(s) 29 beneath each screw 25 that is to extend from a foundation unit. Pad(s) 29 provide a stable base for each screw 25 and can therefore simplify the leveling process and ensure its integrity for a long period of time. The pads 29 can be individual members or formed as an elongated pad coextensive with the foundation unit as shown in FIG. 11.

Figure 9:
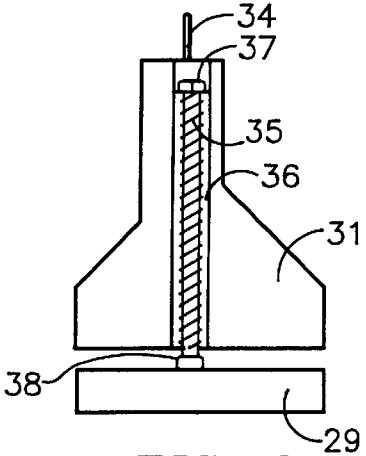
FIG. 9 is a cross-sectional view of an interior foundation unit similarly depicting its leveling mechanism.

A similar construction can be used for each interior foundation unit 30 with the exception that no decorative facade is required. Accordingly, the cross-section of an interior foundation unit 30 shown in FIG. 9 is nearly identical to FIG. 8. Reference numerals depicting elements similar to those used for exterior foundation unit 20 simply start with a "3". Thus, no further description of FIG. 9 will be provided herein.

Figure 10:
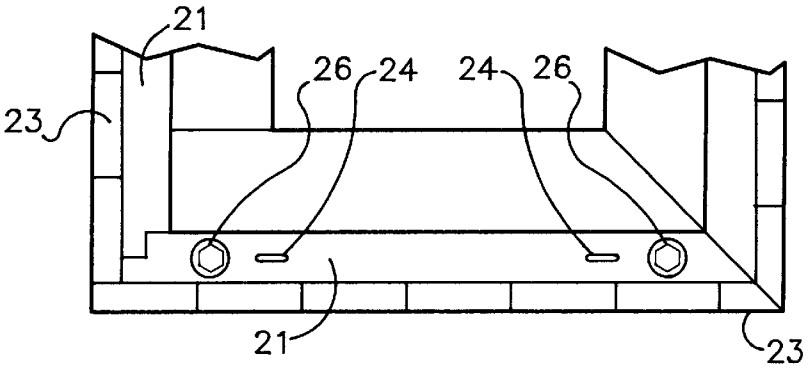
FIG. 10 is a top view of two methods of joining exterior foundation units to form a right-angled corner.

FIG. 10 depicts a top view of exterior foundation units being joined to form 90° corners in accordance with two different methodologies, both of which are acceptable. For example, the left corner is formed by staggered ends of foundation units to provide interlocking bases 21 and facades 23. The right corner is formed by providing a 45° splice in each base 21 and facade 23. The corner units can be tied together by any suitable arrangement such as by embedded bolts (not shown).

Each facility and/or hallway unit is tied-down to the foundation units on which they rest. One embodiment for accomplishing the tie-down function to an exterior foundation unit is depicted in FIG. 11. For example, an access panel 11G in wall 11B can be moved to provide access to the support area of floor 11F. A cable 40 is fixedly coupled to a portion of the structure (e.g., floor 11F as shown or floor joist 11J) of facility unit 11. A hook 42 is provided at the free end of cable 40 for coupling to the eye portion of eye bolt 24. A cable tension device, e.g., a turnbuckle 44, is provided in-line with cable 40 and hook 42 to allow for the adjustment of tension in cable 40 with hook 42 in place on eye bolt 24. Similar tie-down devices can be used to attach facility and/or hallway units to interior foundation units where access to an interior foundation unit is via an access panel provided in the floor of a facility unit.

The modular building is held down to resist winds and other forces by the weight of the foundation and the building itself. If this weight is believed to be insufficient, it may be augmented by additional ground anchors which are well known.

Figure 4:
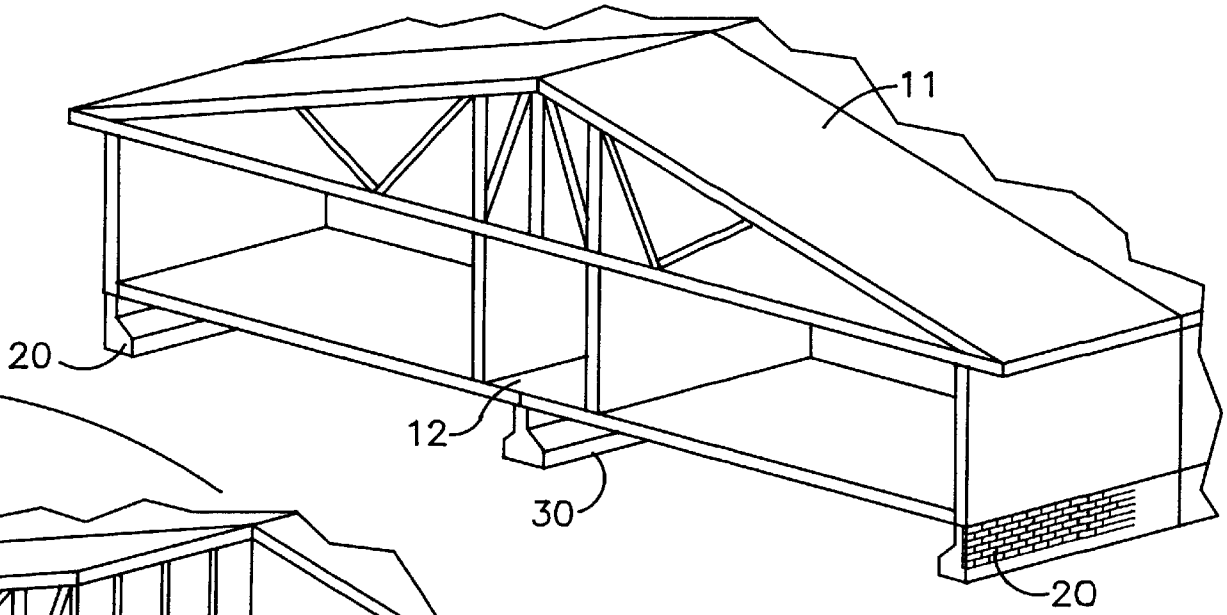
FIG. 4 is a perspective view of the modular building structure of FIG. 3 with the next facility unit in position on the interior and exterior foundation units.
Figure 5:
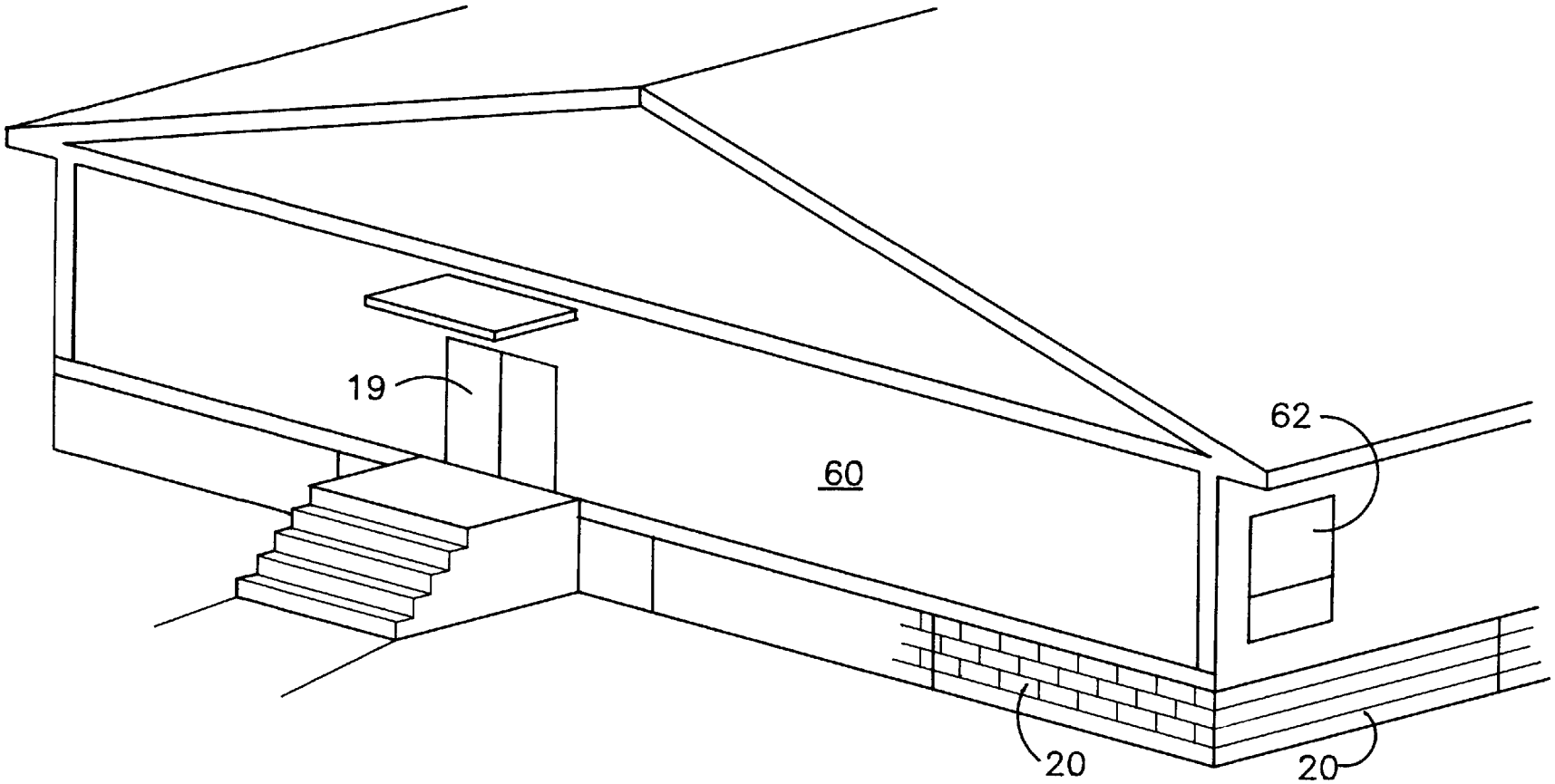
FIG. 5 is a perspective view of the outboard end of a fully-constructed modular building structure of the present invention that includes an entrance/egress door to the hallway formed by the facility units.
Figure 12:
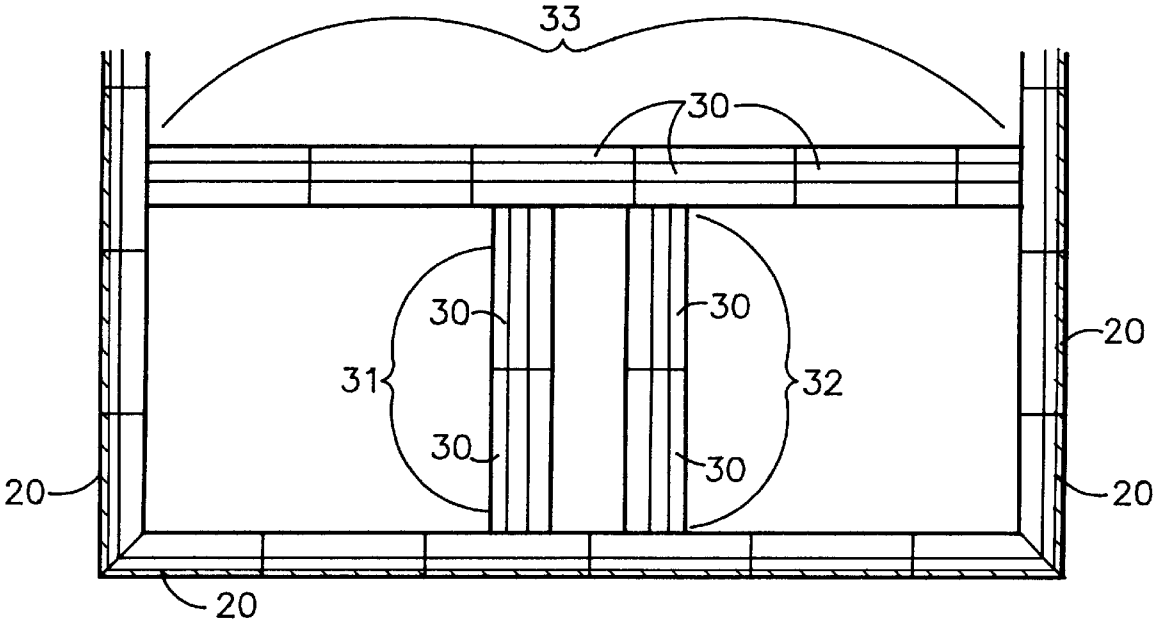
FIG. 12 is a top plan view of an alternative layout of a modular building structure's interior foundation units for directly supporting the structure's hallway walls.
Figure 13:
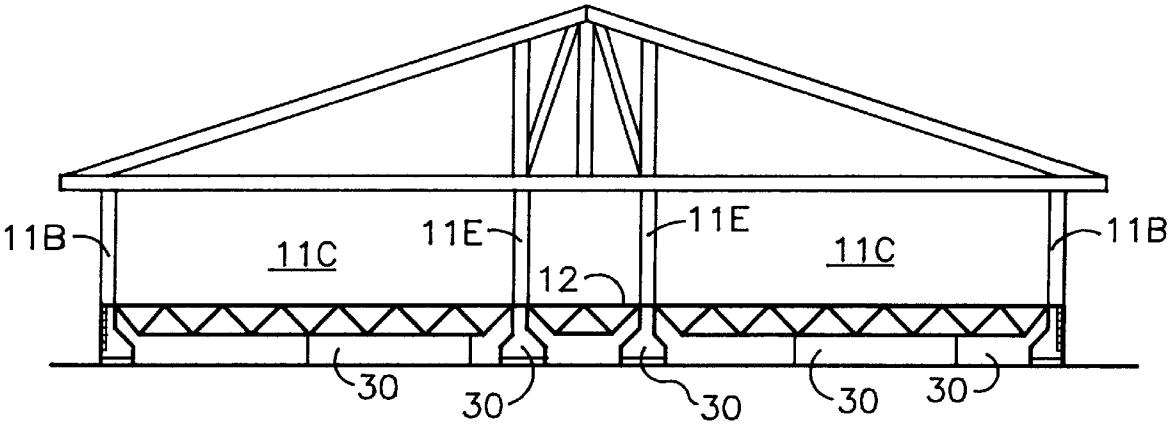
FIG. 13 is a sectional elevation view of the modular building structure constructed on top of the foundation layout depicted in FIG. 12.

During the assembly of the modular building structure embodiment shown in FIGS. 3, 4 and 5, a single linearly-arranged plurality of interior foundation units 30 are used to support the interior portion (i.e. the hallway) of each facility unit. However, the present invention is not limited to this construction. For example, the embodiment depicted in FIGS. 12 and 13 utilizes parallel sets 31 and 32 of linearly-arranged interior foundation units 30 positioned such that walls 11E of hallway 12 are provided with direct foundation support. In addition, another linearly-arranged set 33 of foundation units 30 can span the perimeter defined by exterior foundation units 20 and be positioned to provide direct foundation support to sidewall 11C.

The advantages of the present invention are numerous. The modular building structures can be simply assembled adjacent any permanent existing structure to provide ready expansion thereof. The permanent existing structure may be of vintage construction or newly built. The foundation units are easily leveled even on relatively uneven ground. Thus, extensive site preparation is unnecessary. The foundation and facility/hallway units can be finished to be architecturally compatible with the existing structure. Tie-down of facility/hallway units to foundation units is simple and easily reversed if/when it becomes necessary or desirable to disassemble the modular building structure and store and re-use it. By making the hallway of the modular building structure a continuation of the hallway of the existing structure, the modular building structure is readily integrated into the flow of the existing structure.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A structure comprising:

a plurality of heavy elongated transportable horizontal foundation beams arranged contiguously along the ground to define a perimeter of said structure, each of said plurality of foundation beams having a vertical adjustment mechanism carried thereby for leveling said foundation beam relative to adjacent foundation beams and said foundation beams having a fixture for coupling a tie-down device thereto;

at least one building unit resting atop said plurality of foundation beams arranged contiguously along the ground, said at least one building unit having preassembled floor, walls and a root wherein a portion of each of said walls located over said foundation beams are able to be moved to provide access to said mechanism and said fixture of said foundation beams; and a plurality of tie-down devices connected to said building unit and said fixture of said foundation beams whereby said building unit is connected to said foundation beams.

2. A structure as in claim 1 wherein said mechanism for leveling comprises a plurality of screws passing vertically through each of said plurality of foundation beams and accessible from the top of each of said plurality of foundation beams, wherein each of said plurality of screws are able to be independently rotated to extend from the bottom of a corresponding one of said plurality of foundation beams in order to level a foundation beam relative to said adjacent foundation beams.

3. A structure as in claim 2 further comprising rigid pads placed beneath a portion of said plurality of foundation beams for receiving each of said plurality of screws rotated to extend from the bottom of corresponding ones of said plurality of foundation beams.

4. A structure as in claim 1 wherein said fixture comprises at least one eye bolt anchored in each of said plurality of foundation beams.

5. A structure as in claim 1 wherein each of said plurality of tie-down devices includes:

a cable; and a cable tension device coupled to said cable for adjusting the tension in said cable.

6. A structure comprising:

a plurality of exterior heavy elongated transportable horizontal foundation beams arranged contiguously along the ground to define a perimeter of said structure, each of said plurality of exterior foundation beams having a mechanism for leveling said exterior foundation beam relative to adjacent exterior foundation beams, each of said plurality of exterior foundation beams having a decorative finish on one vertical face thereof, and each of said plurality of exterior foundation beams having a fixture for the coupling of a tie-down thereto;

a plurality of elongated interior foundation beams arranged contiguously along the ground to define at least one linear support within said perimeter of said structure, each of said plurality of interior foundation beams having a mechanism for leveling said interior foundation beam relative to adjacent interior foundation beams and relative to said plurality of exterior foundation beams, and each of said plurality of interior foundation beams having a fixture for the coupling of a tie-down thereto;

a plurality of building units, each of said plurality of building units resting atop at least one of said plurality of exterior foundation beams and at least one of said plurality of interior foundation beams, each of said plurality of building units having a floor, walls and a roof, wherein a portion of each of said plurality of building units resting atop said at least one of said plurality of exterior foundation beams and resting atop said at least one of said plurality of interior foundation beams are able to be moved to provide access to said mechanism and said fixture of said at least one of said plurality of exterior foundation beams and said mechanism and said fixture of said at least one of said plurality of interior foundation beams; and a plurality of tie-down devices connected to each of said plurality of building units and to said fixture of said at least one of said plurality of exterior foundation beams and connected to said fixture of said at least one of said plurality of interior foundation beams whereby said building units are connected to said foundation units.

7. A structure as in claim 6, wherein said mechanism for leveling in each of said plurality of exterior foundation beams comprises a plurality of screws passing vertically through each of said plurality of exterior foundation beams and accessible from the top of each of said plurality of exterior foundation beams, wherein each of said plurality of screws are able to be independently rotated to extend from the bottom of a corresponding one of said plurality of exterior foundation beams in order to level said exterior foundation beam relative to said adjacent exterior foundation beams, and wherein said mechanism for leveling in each of said plurality of interior foundation beams comprises a plurality of screws passing vertically through each of said plurality of interior foundation beams and accessible from the top of each of said plurality of interior foundation beams, wherein each of said plurality of screws are able to be independently rotated to extend from the bottom of a corresponding one of said plurality of interior foundation beams in order to level said interior foundation beam relative to said adjacent interior foundation beams and said plurality of exterior foundation beams.

8. A structure as in claim 7 further comprising rigid pads placed beneath a portion of said plurality of exterior foundation beams for receiving each of said plurality of screws rotated to extend from the bottom of corresponding ones of said plurality of exterior foundation beams, and placed beneath a portion of said plurality of interior foundation beams for receiving each of said plurality of screws rotated to extend from the bottom of corresponding ones of said plurality of interior foundation beams.

9. A structure as in claim 6, wherein said fixture in each of said plurality of exterior foundation beams comprises at least one eye bolt anchored in each of said plurality of exterior foundation beams, and wherein said fixture in each of said plurality of interior foundation beams comprises at least one eye bolt anchored in each of said plurality of interior foundation beams.

10. A structure as in claim 6 wherein each of said plurality of tie-down devices includes:

a cable; and a cable tension device coupled to said cable for adjusting the tension in said cable.

11. A building structure comprising:

a permanent and complete building having a wall with a hall opening located in said wall;

a semipermanent hall structure having an inboard opening connected to said hall opening and having an outboard opening at the opposite end of said hall structure from said inboard opening;

a semipermanent reusable modular building having at least two joined together semipermanent and movable facility units and including a hallway with an inboard end and an outboard end with said hallway inboard end joined to said hall structure outboard opening;

a plurality of heavy elongated transportable horizontal foundation beams upon which said modular building and said facility units;

said foundation beams include a plurality of exterior foundation beams arranged along the ground to define a perimeter of said modular building, that includes exterior hallway foundation beams formed by at least two of opposing ones of said plurality of exterior foundation beams, each of said plurality of exterior foundation beams having a mechanism for leveling relative to adjacent ones of said plurality of exterior foundation beams, and each of said plurality of exterior foundation beams having a fixture for the coupling of a tie-down thereto;

a plurality of heavy elongated transportable horizontal interior foundation beams arranged contiguously along the ground to define at least one linear support within said perimeter of said exterior foundation beams, each of said plurality of interior foundation beams having a mechanism for leveling relative to adjacent ones of said plurality of interior foundation beams and relative to said plurality of exterior foundation beams, and each of said plurality of interior foundation beams having a fixture for the coupling of a tie-down thereto;

each of said facility units resting atop at least one of said plurality of exterior foundation beams and at least one of said plurality of interior foundation beams, each of said facility units having a floor, walls and a roof, wherein said facility units include a portion of each of said facility units located atop of said foundation beams which are able to be moved to provide access to said mechanism and said fixture of said at least one of said plurality of exterior foundation beams of said facility foundation and said mechanism and said fixture of said at least one of said plurality of interior foundation beams; and joining connectors connecting said modular building and said movable facility units to said foundation in a semipermanent manner.

12. A building structure as in claim 11 wherein said walls of each of said facility units define at least a portion of a room and at least a portion of said hallway aligned with said hall structure.

13. A modular structure as in claim 12 further comprising a door at an end of said hallway aligned with said hall structure.

14. A building structure as in claim 12 wherein said plurality of interior foundation beams define at least two parallel linear supports directly supporting said walls defining either side of said hallway aligned with said hall structure.

15. A building structure as in claim 12 wherein said walls of each said room define a doorway providing access to said hallway aligned with said hall structure.

16. A building structure as in claim 11 further comprising at least one door in said hall structure providing an entrance/egress from outside said hall structure.

17. A building structure as in claim 11, wherein said mechanism for leveling in each of said plurality of exterior foundation beams comprises a plurality of screws passing vertically through each of said plurality of exterior foundation and accessible from the top of each of said plurality of exterior foundation beams, wherein each of said plurality of screws are able to be independently rotated to extend from the bottom of a corresponding one of said plurality of exterior foundation beams in order to level said exterior foundation beam relative to said adjacent ones of said plurality of exterior foundation beams, and wherein said mechanism for leveling in each of said plurality of screws passing vertically through each of said plurality of interior foundation beams and accessible from the top of each of said plurality of interior foundation beams, wherein each of said plurality of screws are to be independently rotated to extend from the bottom of a corresponding one of said plurality of interior foundation beams in order to level said interior foundation beam relative to said adjacent ones of said plurality of interior foundation beams and said plurality of exterior foundation beams.

18. A building structure as in claim 11, wherein said fixture in each of said plurality of exterior foundation beams comprises at least one eye bolt anchored in each of said plurality of exterior foundation beams, and wherein said fixture in each of said plurality of interior foundation beam so comprises at least one eye bolt anchored in each of said plurality of interior foundation.

19. A building structure as in claim 11, further comprising rigid pads placed beneath a portion of said plurality of exterior foundation beams for receiving each of said Plurality of screws rotated to extend from the bottom of corresponding ones of said plurality of exterior foundation beams, and placed beneath a portion of said plurality of interior foundation beams for receiving each of said plurality of screws rotated to extend from the bottom of corresponding ones of said plurality of interior foundation beams.

* * * * *